US006864762B2

(12) United States Patent
Yahata et al.

(10) Patent No.: US 6,864,762 B2
(45) Date of Patent: Mar. 8, 2005

(54) BANDPASS FILTER AND APPARATUS USING SAME

(75) Inventors: Norihiro Yahata, Aichi (JP); Hitoshi Hirano, Aichi (JP); Hiroshi Nagai, Ichinomiya (JP); Naomi Nagata, Tajimi (JP); Nobuhiro Kani, Kakamigahara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 27 days.

(21) Appl. No.: 10/383,764

(22) Filed: Mar. 10, 2003

(65) Prior Publication Data

US 2003/0231084 A1 Dec. 18, 2003

(30) Foreign Application Priority Data

Mar. 26, 2002 (JP) ..... 2002-085266

(51) Int. Cl.[7] ..... H11P 1/203
(52) U.S. Cl. ..... 333/204; 333/203; 333/219
(58) Field of Search ..... 333/202, 204, 333/205, 219, 235, 246, 203

(56) References Cited

U.S. PATENT DOCUMENTS 5,045,815 A * 9/1991 Avanic et al. ..... 331/96
5,164,690 A * 11/1992 Yeh et al. ..... 333/204
5,365,173 A * 11/1994 Zou et al. ..... 324/318
5,838,213 A * 11/1998 Huang ..... 333/99 S
5,878,333 A * 3/1999 Kitaguchi ..... 455/196.1
6,717,491 B2 * 4/2004 Liang et al. ..... 333/205

FOREIGN PATENT DOCUMENTS

JP 404097602 * 3/1992

* cited by examiner

*Primary Examiner*—Dinh T. Le
(74) *Attorney, Agent, or Firm*—Wenderoth, Lind & Ponack, L.L.P.

(57) ABSTRACT

A bandpass filter disposed on a substrate includes one pair of ring Each of the ring resonators includes a pattern inductor, a resonance capacitor connected in parallel with the pattern inductor, and an input/output terminal connected with the pattern inductor via a coupling capacitor. The pattern inductors are connected with an impedance varying device, whereby the bandpass filter is capable of frequency adjustments.

15 Claims, 7 Drawing Sheets

BANDPASS FILTER AND APPARATUS USING SAME

FIELD OF THE INVENTION

The present invention relates to a bandpass filter formed of ring resonators and an apparatus using the same.

BACKGROUND OF THE INVENTION

A conventional bandpass filter will be described. The conventional bandpass filter as shown in FIG. 12 is formed of ring resonator 5*a* and ring resonator 5*b* disposed on a substrate (not shown). Ring resonator 5*a* is made up of pattern inductor 1*a*, resonance capacitor 2*a* connected in parallel with pattern inductor 1*a*, and input/output terminal 4*a* connected with the pattern inductor 1*a* via coupling capacitor 3*a*. Ring resonator 5*b* is made up of pattern inductor 1*b*, resonance capacitor 2*b* connected in parallel with pattern inductor 1*b*, and input/output terminal 4*b* connected with pattern inductor 1*b* via coupling capacitor 3*b*.

In order to obtain electromagnetic coupling between ring resonator 5*a* and ring resonator 5*b*, a portion of pattern inductor 1*a* and a portion of pattern inductor 1*b* are arranged to oppose each other, whereby a bandpass filter is provided. As the first resonance capacitor 2*a* and the second resonance capacitor 2*b*, chip capacitors mounted on the substrate have so far been used.

In bandpass filters formed of ring resonators as described above, the resonance line, in general, is not grounded. Therefore, it is not possible for them to induce stray inductances and therefore have merit in that their circuits provide enhanced stability. Further, it is possible to provide attenuation poles on both sides of the center frequency so that greater attenuation can be obtained in the vicinity of the passband. Further, the insertion loss caused by the filter can be reduced as compared with that of a quarter-wave filter or a combline filter, which has its resonance line grounded.

However, in the bandpass filter configured as described above, the center frequency of passband deviates, due to variations of resonance chip capacitors 2*a*, 2*b*. For example, in a bandpass filter having a passband of 6 MHz, the center frequency of passband deviates approximately 50 MHz against the 6 MHz passband. When such a bandpass filter is to be applied, for example, to an intermediate frequency circuit in a tuner, it has been necessary to reduce the variations of the resonance capacitors prior to the mounting of the capacitors on a filter substrate. Therefore, it has been necessary to provide equipment and expense for sorting out of the resonance capacitors.

SUMMARY OF THE INVENTION

It is an object of the present invention to solve the above-mentioned problem by providing a bandpass filter that does not require the sorting out of the resonance capacitors.

To attain the objective, the bandpass filter of the present invention has impedance varying means for varying impedance of the pattern inductor.

DETAILED DESCRIPTION

Exemplary embodiments of the present invention will be described with reference to the accompanying drawings.

(Exemplary Embodiment 1)

Figure 1A:
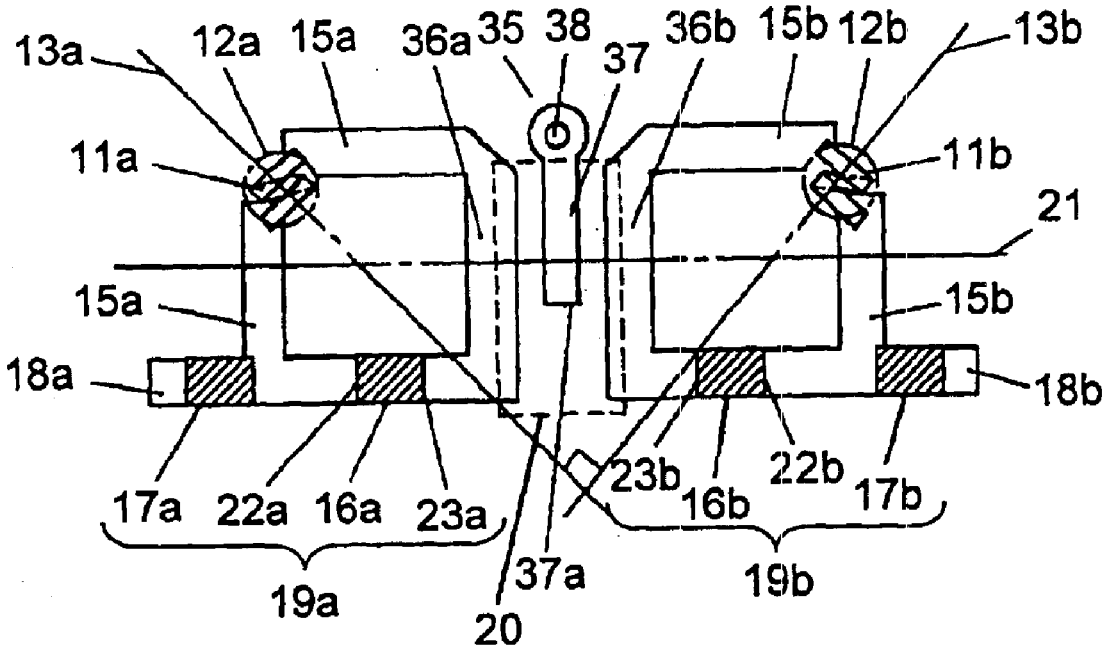
FIG. 1A is a plan view of a bandpass filter according to an embodiment of the present invention.
Figure 1B:
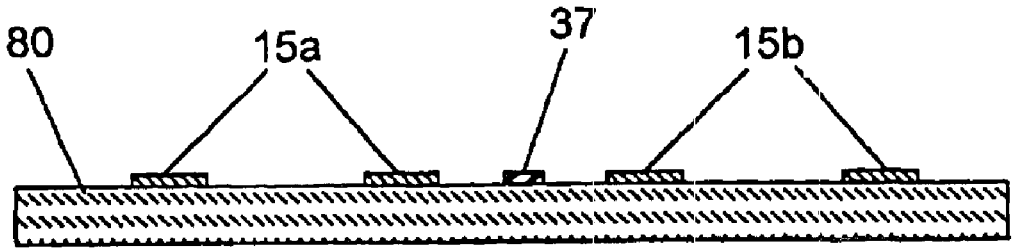
FIG. 1B is a sectional view taken along the centerline of FIG. 1A.

The bandpass filter described in embodiment 1, configured as shown in FIG. 1A or 1B, includes a pair of ring resonators 19*a*, 19*b* formed on substrate 80 and adjustment piece 37 formed in an area sandwiched between the two ring resonators. More specifically, ring resonator 19*a* on one side includes pattern inductor 16*a* having low-turn (i.e., small winding numbers) air-core coil 11*a* connected in series therewith, resonance capacitor 16*a* connected in parallel with pattern inductor 15*a*, and input/output terminal 18*a* connected with pattern inductor 15*a* via coupling capacitor 17*a*. Ring resonator 19*b* on the other side includes pattern inductor 15*b* having low-turn air-core coil 11*b* connected in series therewith, resonance capacitor 16*b* connected in parallel with pattern inductor 15*b*, and input/output terminal 18*b* connected with pattern inductor 15*b* via coupling capacitor 17*b*. Pattern inductors 15*a* and 15*b* are pattern inductors closely adjoining each other with side 36*a* and side 36*b* in parallel with each other. In the center portion of the area between sides 36*a* and side 36*b* facing each other, there is disposed linear-shaped adjustment piece 37 formed by patterning on substrate 80. Sides 36*a* and 36*b* work as adjoining pattern portions.

Adjustment piece 37 is connected with a ground plane (not shown) formed on the back face of substrate 80 by way of through hole 38 made in substrate 80 at an upper portion with respect to center line 21 passing substantially through the centers of sides 36*a* and 36*b* opposite to each other (at a position around the upper sides of pattern inductors 15*a* and 16*b* in the case of embodiment 1). The above center line passes substantially through the center points of pattern inductors 15*a* and 15*b*.

Pattern inductor 15*a* and pattern inductor 15*b* are both substantially rectangular shaped, 5 mm long and 7 mm wide, and respectively have low-turn air-core coils 11*a* and 11*b* for adjusting the center frequency. The used air-core coil is an air-core coil having a diameter of 2 mm and a number of turns of two. The two air-core coils are mounted such that their center lines 13*a*, 13*b* cross each other at approximately 90 degree angles to eliminate the effect of mutual electromagnetic coupling. Winding pitch (pitch of turns) of air-core coils 11*a* and 11*b* are adjusted for adjustment of the center frequency and thereafter they are fixed in place with adhesive 12*a*, 12*b*. Low-turn coil, here, means a coil whose number of turns is two to four. Use of such a coil with a low number of windings facilitates a minute adjustment of the center frequency.

On the side of ring resonator 19*a*, resonance capacitor 16*a* is soldered to the lower side in FIG. 1A adjoining coupling portion 20 formed between opposing sides 36*a*, 36*b*. Input/output terminal 18*a* is disposed on the side of resonance capacitor 16*a* away from coupling portion 20 (i.e., on the side of positive terminal 22*a* of the resonance capacitor), via coupling capacitor 17*a*. Incidentally, coupling portion 20, here, is the region formed between adjoining pattern inductors 15*a* and 15*b* on substrate 80 and this is the region where electromagnetic coupling takes place. The coupling portion, in embodiment 1, corresponds to the area on substrate 80 surrounded by side 36*a* and side 36*b* opposite to each other.

On the side of ring resonator 19*b*, resonance capacitor 16*b* is soldered to the lower side adjoining coupling portion 20, while input/output terminal 18*b* is disposed on the side of resonance capacitor 16*b* away from coupling portion 20 (i.e., on the side of positive terminal 22*b*), via coupling capacitor 17*b*.

Since, as described above, air-core coils 11*a* and 11*b* as impedance varying means are inserted in each of pattern inductors 16*a* and 15*b*, highly precise adjustment of the center frequency is made possible. Therefore, deviations of the center frequency due to variations in capacitance values of resonance capacitors 16*a* and 16*b* can be corrected by adjusting winding pitch of air-core coils 11*a* and 11*b*.

By the use of air-core coils 11*a*, 11*b* as impedance varying means, the capital investment can be curtailed as compared with adoption of a trimming method using laser beams or the like for changing the center frequency.

The center frequency of the bandpass filter produced in embodiment 1 is approximately 1 GHz. Since capacitors having errors of 3 pF±0.15 pF are used for resonance capacitors 16*a*, 16*b*, the center frequency deviates approximately 50 MHz. Since the center frequency can be adjusted approximately 80 MHz by varying the winding pitches of air-core coils 11*a*, 11*b*, capacitance variations of resonance capacitors 16*a*, 16*b* can be absorbed.

Further, air-core coils 11*a* and 11*b* are mounted such that center axes 13*a* and 13*b* of air-core coils 11*a* and 11*b* cross each other approximately at right angles. Therefore, electromagnetic coupling between air-core coils 11*a* and 11*b* can be reduced. Accordingly, when the winding pitch of one air-core coil is adjusted, resulting variations in characteristics of the other resonator due to the adjustment are suppressed and, thus, frequency adjusting work can be simplified.

After the center frequency has been adjusted, air-core coils 11*a*, 11*b* are fixed onto substrate 80 with adhesive 12*a*, 12*b*. Thereby, changes in shape due to prolonged temperature cycles or the like can be suppressed and long-term stabilization of the shape can be obtained. Incidentally, a solvent rubber-base adhesive is used in the present embodiment, but the adhesive is not limited to one solvent type; namely, a thermosetting or photo-setting adhesive can be used.

Figure 2:
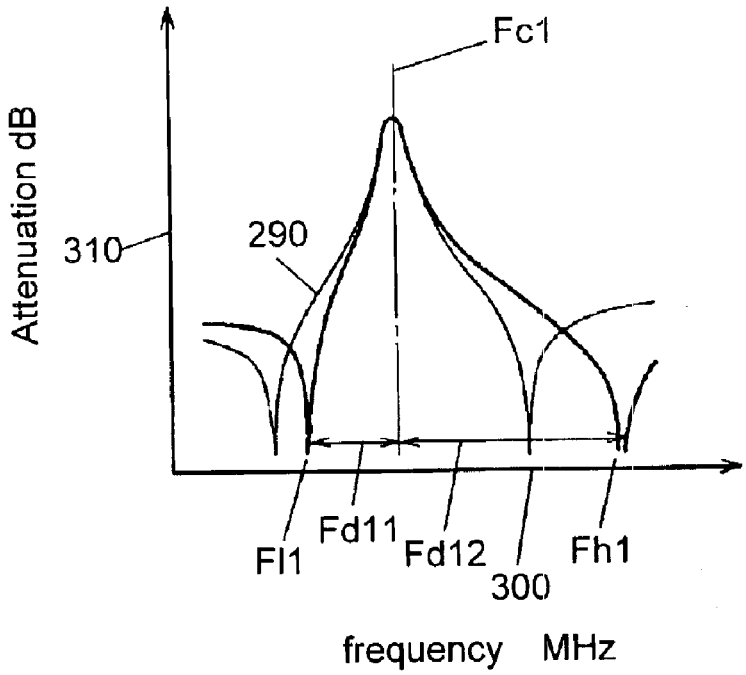
FIG. 2 is a characteristic curve of a bandpass filter according to an embodiment of the invention.

In ring resonators 19*a*, 19*b*, resonance capacitors 16*a*, 16*b* are provided in the lower sides in FIG. 1A adjoining coupling portion 20, while input/output terminals 18*a* and 18*b* are disposed on the sides of resonance capacitors 16*a* and 16*b* away from coupling portion 20 (i.e., on the sides of positive terminal 22*a*) via coupling capacitors 17*a* and 17*b*. By virtue of the described arrangement of coupling capacitors 17*a* and 17*b*, electromagnetic coupling between both ring resonators 19*a* and 19*b* is strengthened at the phase opposite to the phase of the signal excited in ring resonators 19*a* and 19*b*, i.e., at negative-phase terminals 23*a* and 23*b* of resonance capacitors 16*a* and 16*b*. Accordingly, attenuation pole Fl1 on the lower frequency side and attenuation pole Fh1 on the higher frequency side become asymmetric about center frequency Fc1 of the bandpass filter as shown in FIG. 2.

More specifically, distance Fd12 between center frequency Fc1 and attenuation pole Fh1 on the higher frequency side becomes greater than distance Fd11 between attenuation pole Fl1 on the lower frequency side and center frequency Fc1 and, hence, the influence on center frequency Fc1 of attenuation pole Fl1 on the higher frequency side becomes smaller. As a result, increase of insertion-loss at center frequency Fc1 produced when attenuation pole Fl1 on the lower frequency side is brought near to center frequency Fc1 can be reduced from that in the case where characteristic curve 29 has attenuation poles symmetrical about the center frequency. In FIG. 2, horizontal axis 300 represents frequency (MHz) and vertical axis 310 represents attenuation (dB). The filter shown therein is useful in an application requiring greater attenuation in the neighborhood of a frequency range on the lower frequency side of the center frequency.

Figure 3:
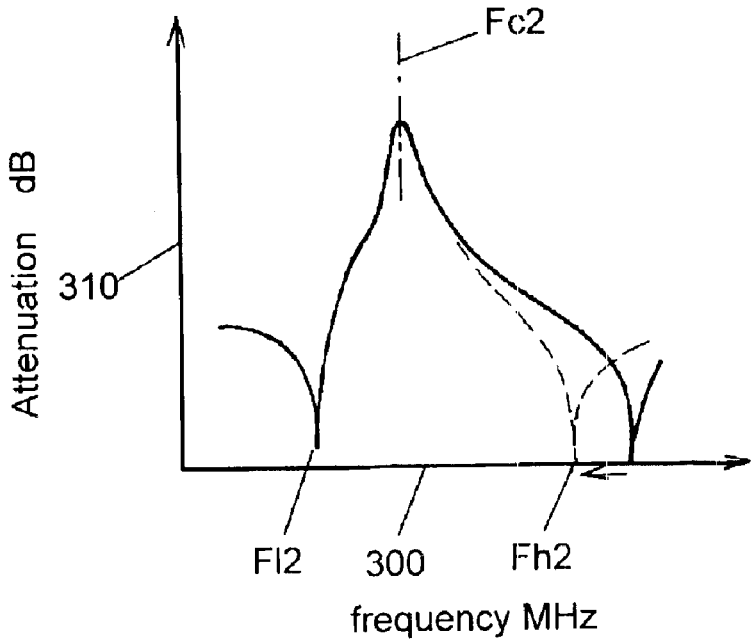
FIG. 3 is a characteristic curve of a bandpass filter according to an embodiment of the invention.

Further, by providing coupling adjustment means 35 made of a conductive pattern, it becomes possible to move one of the asymmetrically formed attenuation poles, i.e., attenuation pole Fh1, farther away from center frequency Fc1. When it is desired to adjust the frequency of attenuation pole Fh2 on the higher frequency side, adjustment piece 37 can be gradually trimmed from the side of end 37*a*. Then, attenuation pole Fh2 will gradually be moved near to center frequency Fc2 as shown in FIG. 3. Relative positions between attenuation pole Fl2 on the lower frequency side and attenuation pole Fh2 on the higher frequency side with respect to center frequency Fc2 are independent of capacitance values of resonance capacitors 16*a* and 16*b*, hence kept from varying. Therefore, the work for adjusting the positions of both of the attenuation poles by using coupling adjustment means 35 is required to be carried out only at the designing stage. In the case of embodiment 1, coupling adjustment means 35 is provided by a pattern of an exposed inner-layer metal of substrate 80 on which the bandpass filter is mounted. As substrate 80, a circuit board having circuit patterns thereon, a dual-sided circuit board, a multilayer circuit board, and the like can be used.

In the case of embodiment 1, center frequency Fc1, Fc2 is 1 GHz and the bandwidth is 6 MHz. Distance Fd11 between center frequency Fc1 and attenuation pole Fl1 is 100 MHz and distance Fd12 between center frequency Fc1 and attenuation pole Fh1 is 200 MHz.

(Exemplary Embodiment 2)

Figure 4:
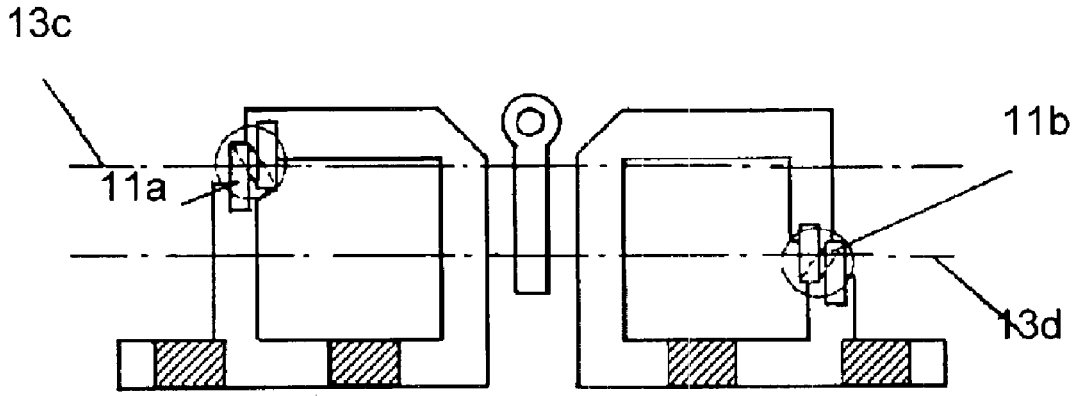
FIG. 4 is a plan view of a bandpass filter according to an embodiment of the invention.

As shown in FIG. 4, embodiment 2 is such that has low-turn (small winding numbers) air-core coils 11*a* and 11*b* for adjusting the center frequency mounted thereon with their center lines 13*c* and 13*d* arranged in parallel with each other and their center lines 13*c* and 13*d* spaced from each other a greater distance than the diameter of air-core coils 11*a*, 11*b*. By having air-core coils 11*a*, 11*b* mounted in the described way, the electromagnetic coupling between the air-core coils can be weakened. Thus, while the winding pitch of one of the air-core coils is adjusted, the resonance characteristic of the other resonator can be prevented from varying and, hence, simplification of frequency adjusting work can be attained.

(Exemplary Embodiment 3)

Figure 5:
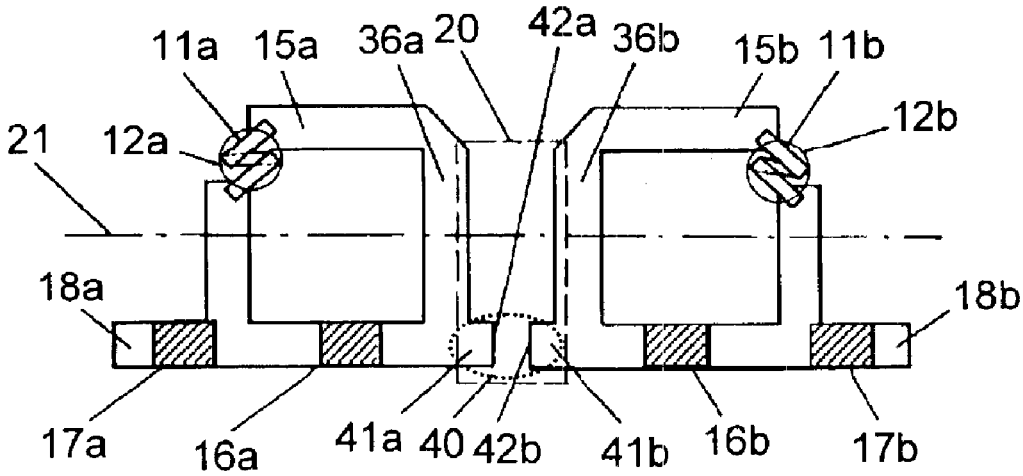
FIG. 5 is a plan view of a bandpass filter according to an embodiment of the invention.

Embodiment 3 has coupling adjustment means 40 located in the area of coupling portion 20 as shown by dotted line in FIG. 5. This coupling adjustment means 40 is provided by patterns of projected portions 41*a*, 41*b* projected toward the center of coupling portion 20 from the lower portion of opposing sides 36*a* and 36*b* of pattern inductors 15*a* and 15*b*.

Figure 6:
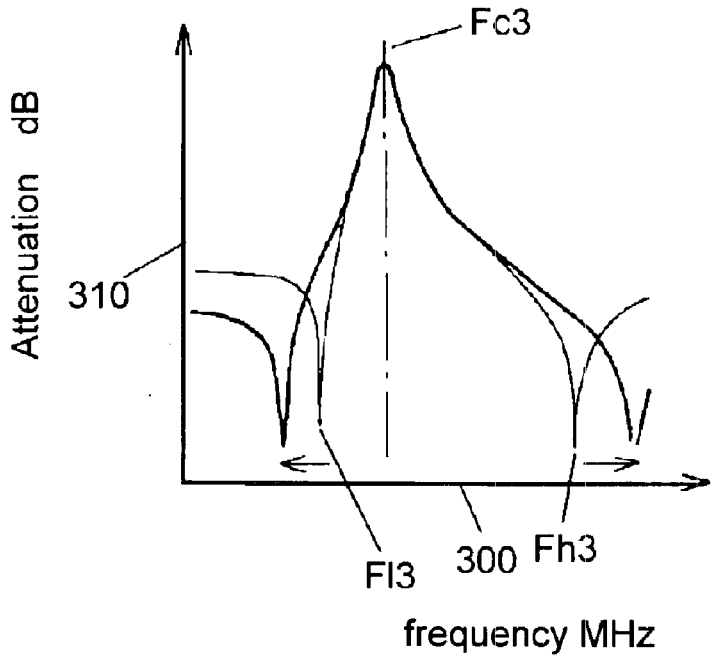
FIG. 6 is a characteristic curve of a bandpass filter according to an embodiment of the invention.

By gradually trimming projected portions 41*a*, 41*b* from the side of tip ends 42*a*, 42*b*, positions of attenuation poles Fl3, Fh3 can be adjusted as shown in FIG. 6. More specifically, by gradually trimming the projected portions from the side of tip ends 42*a*, 42*b*, attenuation poles Fl3, Fh3 are gradually moved away from center frequency Fc3.

Thus, attenuation pole Fl3 on the lower frequency side can be adjusted to a desired frequency. Then, since attenuation pole Fl3 and attenuation pole Fh3 become asymmetrically arranged about center frequency Fc3, great attenuation at a desired frequency region on the lower frequency side can be obtained, while increase of the insertion-loss at center frequency Fc3 is suppressed due to asymmetrical attenuation pole Fh3.

As with embodiment 1, the relative positions between attenuation pole Fl3 on the lower frequency side and attenuation pole Fh3 on the higher frequency side to center frequency Fc1 are independent of capacitance values of resonance capacitors 16*a* and l6*b*, hence kept from varying. Therefore, the work for adjusting the positions of both of attenuation poles Fl3 and Fh3 by using coupling adjustment means 40 is required to be carried out only at the designing stage and further coupling adjustment means 40 can be provided by a low-priced pattern of a substrate.

By combining coupling adjustment means 35 in embodiment 1 and coupling adjustment means 40 in embodiment 3 together, the adjustable range can be further enlarged.

(Exemplary Embodiment 4)

In embodiment 4, attenuation pole Fl1 on the lower frequency side is spaced a greater distance from the position of center frequency Fc1 shown in FIG. 2 than attenuation pole Fh1 on the higher frequency side. Namely, embodiment 4 has its attenuation poles arranged asymmetrically in a reverse relationship to that of embodiment 1, embodiment 2, and embodiment 3.

Figure 7:
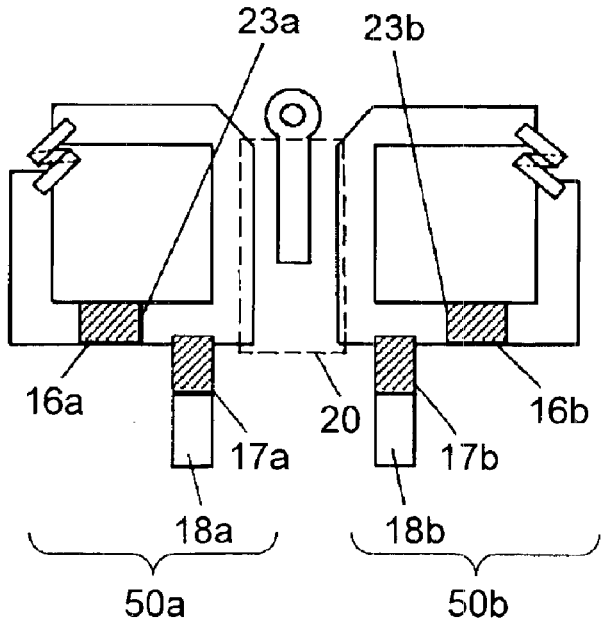
FIG. 7 is a plan view of a bandpass filter according to an embodiment of the invention.

In order to realize a bandpass filter having such a characteristic, the portion between resonance capacitor 16*a* and coupling portion 20 (i.e., the side of negative-phase terminal 23*a* of resonance capacitor 16*a*) is connected to input/output terminal 18*a* via coupling capacitor 17*a* as shown in FIG. 7. Further, the portion between resonance capacitor 16*b* and coupling portion 20 (i.e., negative-phase terminal 23*b* of resonance capacitor 16*b*) is connected to input/output terminal 18*b* via coupling capacitor 17*b*.

Figure 8:
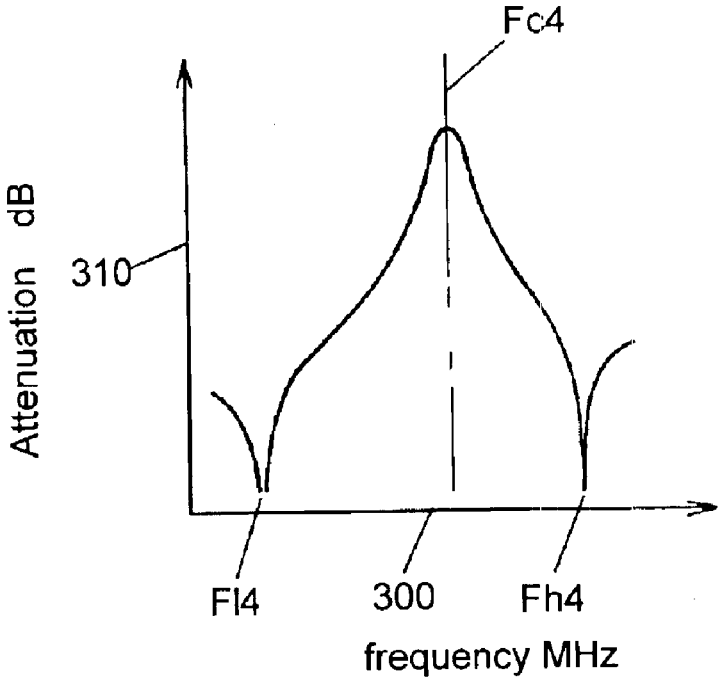
FIG. 8 is a characteristic curve of a bandpass filter according to an embodiment of the invention.

By virtue of the connections of coupling capacitors 17*a* and 17*b* described above, electromagnetic coupling between both ring resonators 50*a* and 50*b* is strengthened at the phase the same as the phase of the signal excited by ring resonators 50*a* and 50*b*. Accordingly, attenuation pole Fl4 on the lower frequency side can be located farther away from center frequency Fc4 than attenuation pole Fh4 on the higher frequency side as shown in FIG. 8.

Also, coupling adjustment means 35 shown in embodiment 1 or coupling adjustment means 40 shown in embodiment 3 can be used together with the arrangement of embodiment 4.

(Exemplary Embodiment 5)

Figure 9:
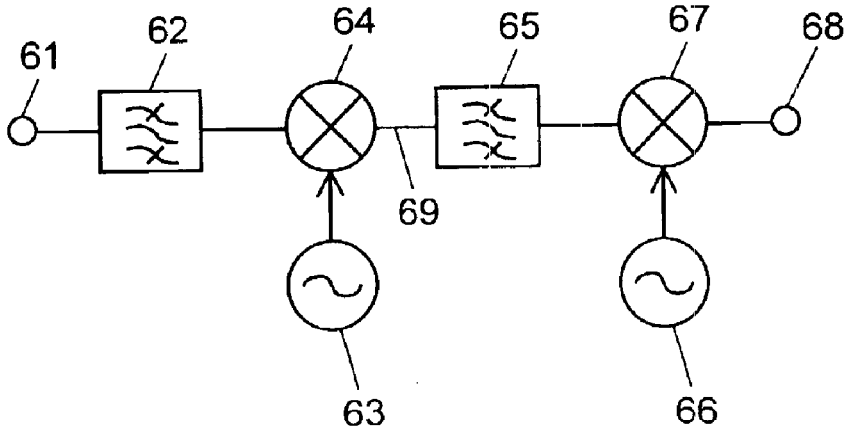
FIG. 9 is a block diagram of a high-frequency apparatus employing a bandpass filter according to an embodiment of the invention.

Embodiment 5 is a double superheterodyne receiver (used as an example of a high-frequency apparatus) employing a bandpass filter of the present invention. The double superheterodyne receiver includes, as shown in FIG. 9, input terminal 61 supplied with a high-frequency signal fixed input filter 62 supplied with the input signal fed to input terminal 61, mixer 64 having one input terminal thereof supplied with the output of input filter 62 and the other input terminal connected with an output of local oscillator 63, bandpass filter 65 of the present invention supplied with the output 69 of mixer 64, mixer 67 having one input terminal thereof supplied with the output of bandpass filter 65 and the other input terminal connected with an output of local oscillator 66, and output terminal 68 supplied with the output of mixer 67.

By using bandpass filter 65 of the present invention, the described configuration has a feature that it can provide a high-frequency apparatus capable of adjusting the center frequency for frequency deviation.

Figure 10:
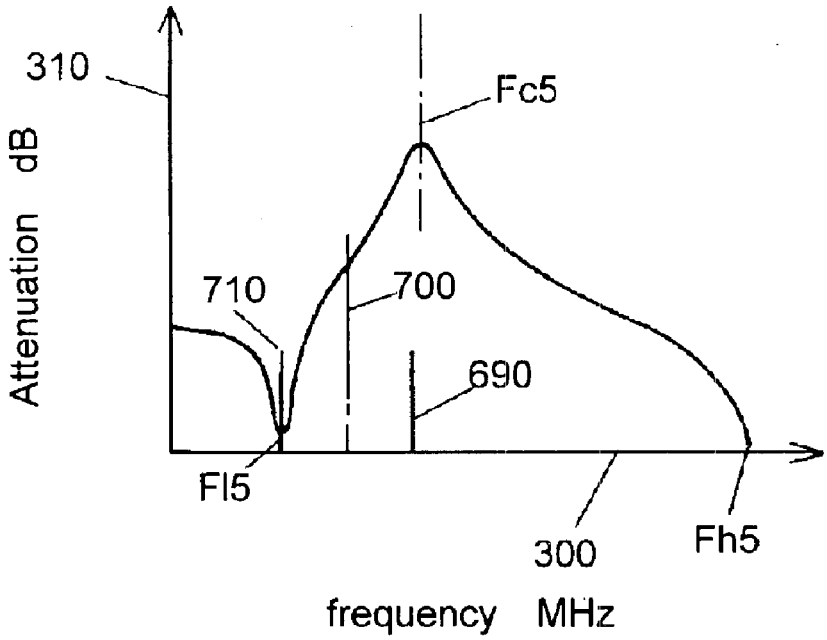
FIG. 10 is a characteristic curve of a bandpass filter according to an embodiment of the invention.

Here, as shown in FIG. 10, output-frequency 69, i.e., the output of mixer 64, having higher frequency than frequency 700 of local oscillator 63 is used as intermediate frequency 690. In this case, any of embodiment 1, embodiment 2, and embodiment 3 can be used as bandpass filter 65. Namely, it is essential here that image disturbance 710 is eliminated by using a bandpass filter in which attenuation pole Fl5 on the lower frequency side is closer to center frequency Fc5 than attenuation pole Fh5 on the higher frequency side. Thereby, while reduction of loss of the passband is realized, great image attenuation can be achieved, and, hence, image disturbance 710 can be positively eliminated.

On the other hand, when the frequency lower than the frequency of local oscillator 63 is used as intermediate frequency 690, i.e., the output of mixer 64, bandpass filter 65 as shown in embodiment 4 is used. That is, image disturbance is eliminated by attenuation pole Fh4 on the higher frequency side. Thereby, while loss of the passband is reduced, image disturbance can be eliminated. Thus, bandpass filter 65 of the present invention is especially effective when used as an intermediate-frequency filter.

(Exemplary Embodiment 6)

Figure 11:
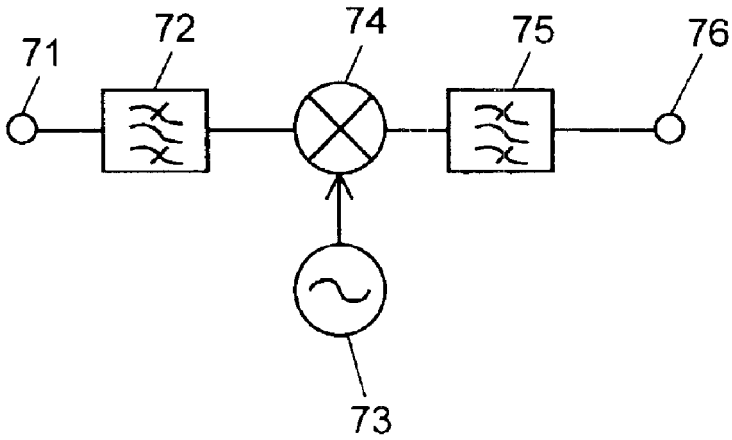
FIG. 11 is a block diagram of a high-frequency apparatus employing a bandpass filter according to an embodiment of the invention.
Figure 12:
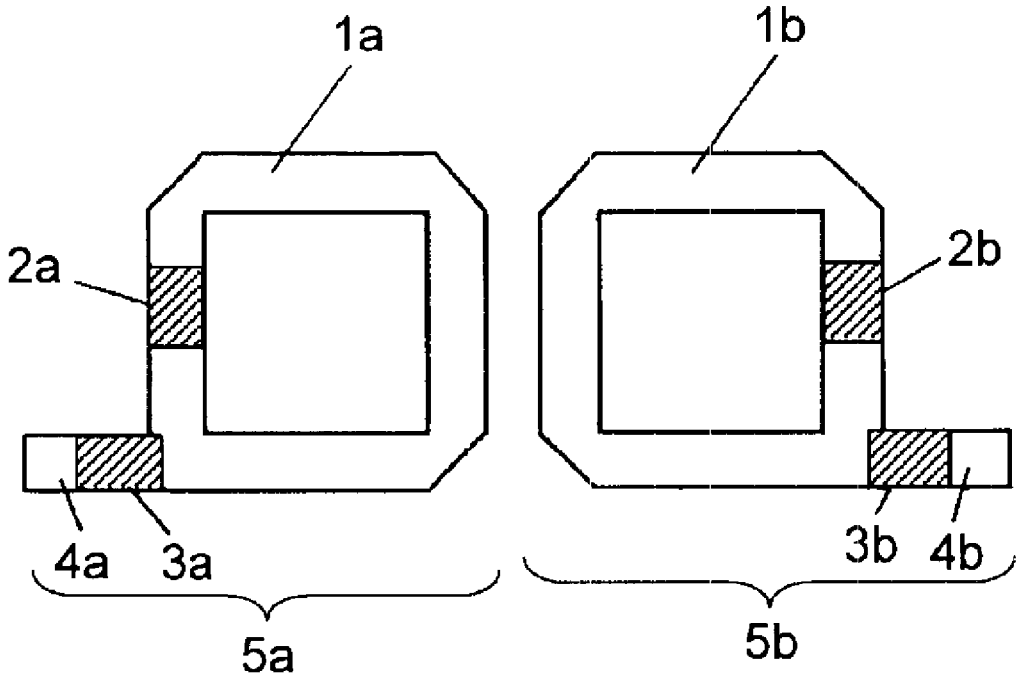
FIG. 12 is a plan view of a conventional bandpass filter.

The embodiment 6 is an example of the use of a bandpass filter of the present invention in a single superheterodyne receiver (a further example of a high-frequency apparatus). Namely, the single superheterodyne receiver shown in FIG. 11 has input terminal 71 supplied with a high-frequency signal, input filter 72 whose center frequency is variable supplied with the signal fed to input terminal 71, mixer 74 with one input terminal supplied with the output of input filter 72 and the other input terminal connected with an output of local oscillator 73, bandpass filter 75 supplied with the output of mixer 74, and output terminal 76 supplied with the output of bandpass filter 75.

Since the single superheterodyne receiver uses the filter of the present invention as the intermediated-frequency filter as described above, a high-frequency signal apparatus capable of adjusting deviation of the center frequency can be provided. Further, adjacent interference signals can be eliminated and the insertion loss of the passband can be reduced.

Advantageous effects of the above described embodiments will be summarized in the following.

The bandpass filter of the present invention by the use of impedance varying means is enabled to correct deviations of the center frequency due to variations of the resonance capacitors. Hence, the need for sorting out of resonance capacitors can be eliminated.

Further, since ring generators are used therein, the filter circuit has a high stability. Further, by having attenuation poles provided on both sides of the center frequency, greater attenuation in the vicinities of the passband can be obtained. Further, insertion loss caused by the filter can be reduced.

Further, by varying the winding pitch of the air-core coil as impedance varying means, the inductance of the air-core coil can be varied and thereby the center frequency can be adjusted.

Further, as the air-core coil having high Q value is used, loss of the bandpass filter is reduced and, consequently, loss of signal at the center frequency is improved.

Further, by adjusting relative orientations between the air-core coils, electromagnetic coupling therebetween can be reduced. Namely, while the winding pitch of one air-core coil is adjusted, changes in the resonating characteristic occurring in the other air-core coil can be suppressed and hence simplification of the frequency adjusting work can be attained.

Further, since changes in shape over a long time of temperature cycling and the like can be suppressed, long-term geometrical stability is provided.

Further, since inter-resonator coupling is strengthened at the opposite phase to (Embodiments 1, 2, and 3), or the same phase as (embodiment 4), the phase of the excited signal in the resonator, the positions of the attenuation poles provided on the higher frequency side and the lower frequency side become asymmetric about the center frequency of the bandpass filter. Hence, while the amount of attenuation is maintained high on either the higher frequency side or the lower frequency side from the center frequency, insertion loss of the center frequency can be reduced from that in the case where the positions of the attenuation poles are symmetrical. Further, since the filter is provided with coupling adjustment means, it is enabled to adjust the positions of the attenuation poles and obtain an optimum amount of attenuation at a desired frequency.

By disposing a linear pattern as the coupling adjustment means in the center of the coupling portion (Embodiment 1), one of the asymmetrically provided attenuation poles can be moved farther away from the center frequency. Accordingly, the influence on the center frequency of the attenuation pole moved farther away is lessened. Thus, the insertion loss of the center frequency can be reduced from that in the case where the attenuation poles are provided symmetrically about the center frequency.

Further, by trimming the pattern, it is also made possible to adjust the frequencies of the attenuation poles to come near to the center frequency.

Further by trimming the patterns that form projected portions (embodiment 3), both attenuation poles can be adjusted to move away from the center frequency. Since they are formed of patterns, this design does not lead to cost increase.

Since two independent coupling adjustment means, i.e., the linear pattern (Embodiment 1) and the projected portions (Embodiment 3), can be used, it is possible, while moving one attenuation pole away from the center frequency, to adjust the other attenuation pole to the frequency region at which a great amount of attenuation is required. Therefore, while the insertion loss of the center frequency is reduced from that in the case where the attenuation poles are symmetrically located, great attenuation at a desired frequency can be obtained. Further, the range of adjustment of the attenuation poles can be enlarged.

Since a high-frequency apparatus of the present invention is employing the filter of the invention as the intermediate-frequency filter in a double superheterodyne receiver, a deviation of the center frequency can be corrected and the need for sorting out of resonance capacitors can be eliminated.

Further, since image disturbing frequencies can be positively eliminated, loss of the passband (intermediate-frequency) can be reduced. Greater benefit can be obtained in the case of an up-down type double superheterodyne receiver in which the output frequency of the first mixer is higher than the input frequency.

Further, since a high-frequency apparatus of the present invention is employing the filter of the present invention as the intermediate frequency filter in a single superheterodyne receiver, a deviation of the center frequency can be corrected and the need for sorting of resonance capacitors can be eliminated.

Further, interference signals can be positively eliminated and loss of the passband (intermediated frequency) can be reduced.

The inductor used in the embodiments of the present invention has been described to be substantially rectangular, but the pattern of the inductor of the present invention includes polygonal shapes other than rectangular shape or those of substantially ring shape.

In brief, the bandpass filters of the present invention have impedance varying means for varying impedance of each pattern inductor, whereby deviations of the center frequency due to variations of the resonance capacitors can be corrected. Accordingly, the need for sorting out of the resonance capacitors can be eliminated.

Further, good stability of the filter circuitry can be obtained since ring resonators are used. Furthermore, greater attenuation of frequency regions in the neighborhood of the passband can be attained by providing attenuation poles on both sides of the center frequency. Besides, the insertion loss caused by the filter can be reduced.

We claim:

1. A bandpass filter comprising a pair of ring resonators formed adjoining each other on a substrate, wherein each of ring resonators comprises:

a pattern inductor having an adjoining pattern portion, wherein said adjoining pattern portions of said rind resonators are located near each other;

a resonance capacitor connected in parallel with said pattern inductor;

a coupling capacitor;

an input/output terminal connected in series with said pattern inductor via said coupling capacitor, said pattern inductor, said resonance capacitor, and said input/output terminal each being formed on the substrate; and impedance varying means connected to said pattern inductor for varying an impedance of said pattern inductor and adjusting a center frequency of said ring resonator.

2. The bandpass filter according to claim 1, wherein said impedance varying means are air-core coils connected in series with said pattern inductors.

3. The bandpass filter according to claim 2, wherein said air-core coils are mounted such that center axes of said air-core coils are perpendicular to each other.

4. The bandpass filter according to claim 2, wherein said air-core coils are mounted such that center axes of said air-core coils are virtually in parallel with each other and a distance between the center axes is greater than a diameter of said air-core coils.

5. The bandpass filter according to claim 2, wherein said air-core coils have a predetermined winding pitch and are fixed onto the substrate with an adhesive.

6. The bandpass filter according to claim 1, further comprising coupling adjustment means formed of a conductor pattern disposed in an area on the substrate between said adjoining pattern portions of said pattern inductors.

7. The bandpass filter according to claim 6, wherein said coupling adjustment means has an elongated rectangular pattern insulated from said pattern inductors, has an asymmetric shape about a center line passing substantially through midpoints of said pattern inductors, and is grounded at one end thereof which is located farther away from the center line.

8. The bandpass filter according to claim 7, wherein said substrate has a through hole filled with a conductor and a grounded pattern connected with said through hole, said through hole being connected with said coupling adjustment means.

9. The bandpass filter according to claim 6, wherein said coupling adjustment means is provided by projected portions of said pattern inductors formed at said adjoining pattern portions.

10. The bandpass filter according to claim 6, wherein said resonance capacitors are connected with said pattern inductors at positions farther away from said adjoining pattern portion-than said coupling capacitors.

11. The bandpass filter according to claim 6, wherein said resonance capacitors are connected with said pattern inductors at positions nearer to said adjoining pattern portion than said coupling capacitors.

12. A high-frequency apparatus comprising:

an input terminal operable to receive a signal;

an input filter supplied with the signal received by said input terminal;

a first mixer supplied with a signal from said input filter and supplied with a signal from a first local oscillator;

a bandpass filter supplied with a signal from said first mixer;

a second mixer supplied with a signal from said bandpass filter and supplied with a signal from a second local oscillator; and an output terminal supplied with a signal from said second mixer;

wherein said bandpass filter comprises a pair of ring resonators formed adjacent to each other on a substrate; and wherein each of said ring resonators comprises:

a pattern inductor having an adjoining pattern portion, wherein said adjoining pattern portions of said ring resonators are located near each other;

a resonance capacitor connected in parallel with said pattern inductor;

a coupling capacitor;

an input/output terminal connected in series with said pattern inductor via said coupling capacitor, said pattern inductor, said resonance capacitor, and said input/output terminal each being formed on the substrate; and impedance varying means connected to said pattern inductor for varying an impedance of said pattern inductor and adjusting a center frequency of said ring resonator.

13. The high-frequency apparatus according to claim 12, wherein said bandpass filter comprises coupling adjustment means formed of a conductor pattern disposed in an area on the substrate between said adjoining pattern portions of said pattern inductors.

14. A high-frequency apparatus comprising:

an input terminal operable to receive a signal;

an input filter supplied with the signal received by said input terminal;

a mixer supplied with a signal from said input filter and supplied with a signal from a local oscillator;

a bandpass filter supplied with a signal from said mixer; and an output terminal supplied with a signal from said bandpass filter, wherein said bandpass filter comprises a pair of ring resonators formed adjacent to each other on a substrate, and wherein each of said ring resonators comprises:

a pattern inductor having an adjoining pattern portion, wherein said adjoining pattern portions of said ring resonators are located near each other;

a resonance capacitor connected in parallel with said pattern inductor;

a coupling capacitor;

an input/output terminal connected in series with said pattern inductor via said coupling capacitor, said pattern inductor, said resonance capacitor, and said input/output terminal each being formed on the substrate, and impedance varying means connected to said pattern inductor for varying an impedance of said pattern inductor and adjusting a center frequency of said ring resonator.

15. The high-frequency apparatus according to claim 14, wherein said bandpass filter comprises coupling adjustment means formed of a conductor pattern disposed in an area on the substrate formed between said adjoining pattern portions of said pattern inductors.

* * * * *